United States Patent [19]

Meisner et al.

[11] Patent Number: 5,011,013

[45] Date of Patent: Apr. 30, 1991

[54] PORTABLE STORAGE CONTAINER

[75] Inventors: Edward Meisner, Short Hills; Michael P. Ballone, New Providence; Young Park, Palisades Park, all of N.J.

[73] Assignee: Waterloo Industries, Inc., Waterloo, Iowa

[21] Appl. No.: 516,031

[22] Filed: Apr. 27, 1990

[51] Int. Cl.[5] ..... B65D 21/02; B65D 43/03

[52] U.S. Cl. ..... 206/373; 206/514; 206/499; 206/506; 312/DIG. 33

[58] Field of Search ..... 206/372, 373, 315.11, 206/510, 501, 514, 519, 499, 505, 506; 312/DIG. 33; 43/54.1; 220/318, 210, 324; 292/113, 247, DIG. 30

[56] References Cited

U.S. PATENT DOCUMENTS

| | | | |
|---|---|---|---|
| 2,941,637 | 6/1960 | Silverman | 292/DIG. 30 X |
| 2,983,402 | 5/1961 | Gottsegen | 292/DIG. 30 X |
| 3,155,270 | 11/1964 | Taft | 292/113 X |
| 3,392,874 | 7/1968 | Peebles | 206/514 |
| 3,586,205 | 6/1971 | Van Daalen | 206/506 X |
| 3,606,511 | 9/1971 | Henning et al. | 206/315.11 X |
| 3,628,843 | 12/1971 | Wynne et al. | 206/373 X |
| 4,029,209 | 6/1977 | Frahm et al. | 206/510 |
| 4,353,182 | 10/1982 | Junkas et al. | 206/315.11 X |
| 4,366,998 | 1/1983 | Kaiser | 312/DIG. 33 X |
| 4,416,372 | 11/1983 | Polk | 206/372 |
| 4,460,085 | 7/1984 | Jantzen | 206/373 X |
| 4,550,828 | 11/1985 | Baldwin et al. | 206/372 X |
| 4,619,363 | 10/1986 | Wolfseder | 206/373 |
| 4,662,515 | 5/1987 | Newby, Sr. | 312/DIG. 33 X |
| 4,674,665 | 6/1987 | Van Kirk | 312/DIG. 33 X |
| 4,714,158 | 12/1987 | Ottman et al. | 312/DIG. 33 X |
| 4,895,256 | 1/1990 | Johnston | 206/501 |

*Primary Examiner*—Paul T. Sewell
*Assistant Examiner*—Jacob K. Ackun, Jr.
*Attorney, Agent, or Firm*—Hedman, Gibson, Costigan & Hoare

[57] ABSTRACT

There is disclosed a portable storage apparatus comprising a container, a cover which is removably mountable on the container and which has a work surface thereon, and a hand-holdable tray assembly insertable into the container in nesting relationship which includes a tray having a centrally located upwardly extending handle which can be used to lift all of the trays out of the container.

24 Claims, 11 Drawing Sheets

FIG. 1
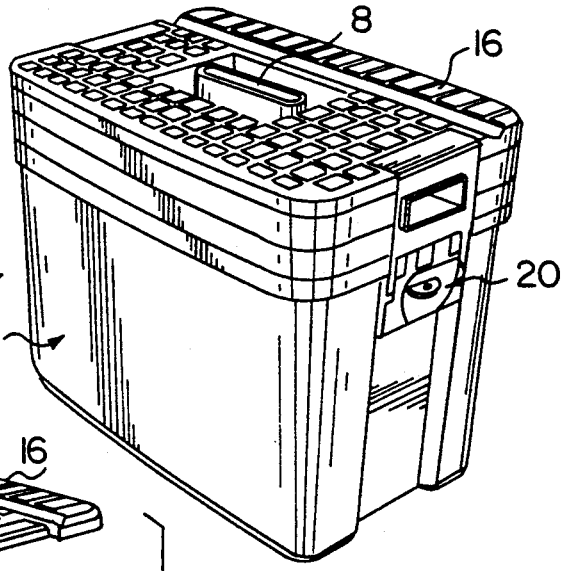
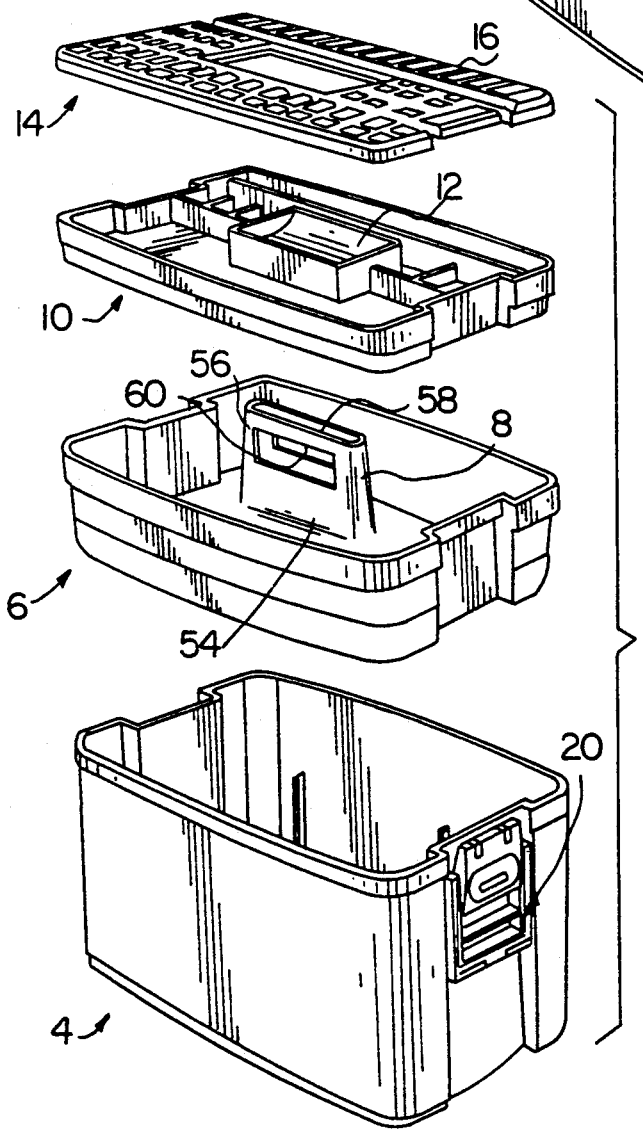
FIG. 2

FIG. 3A
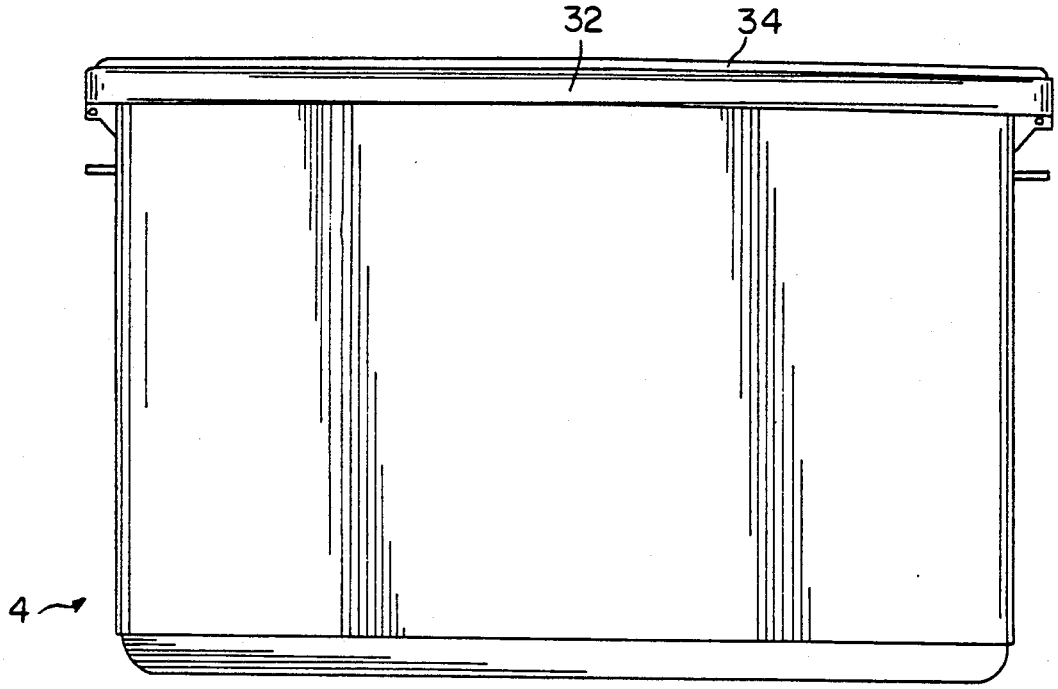
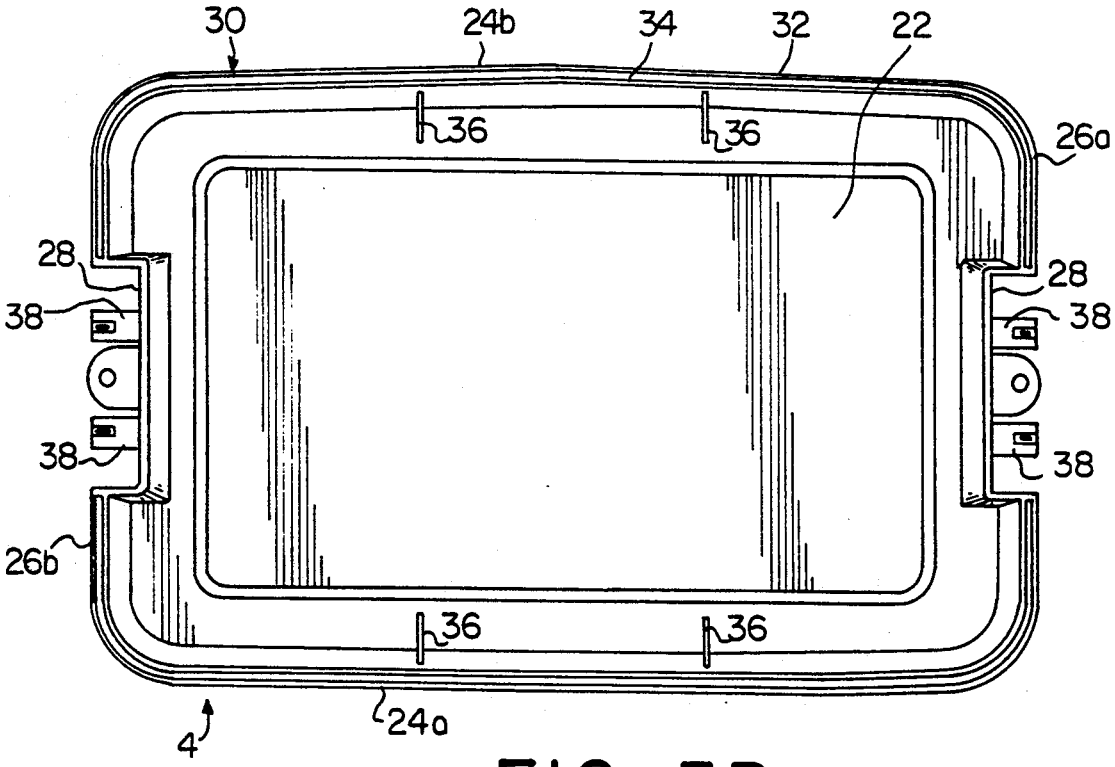
FIG. 3B

FIG. 5A
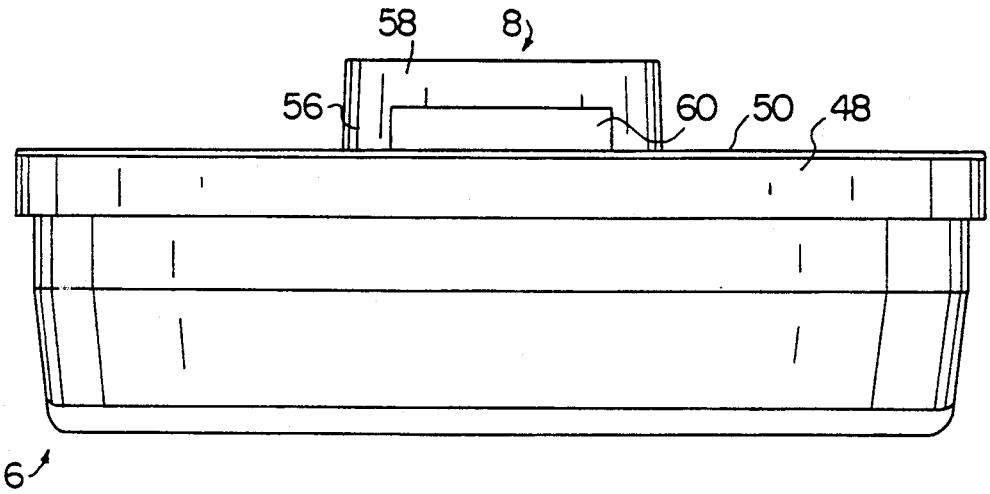
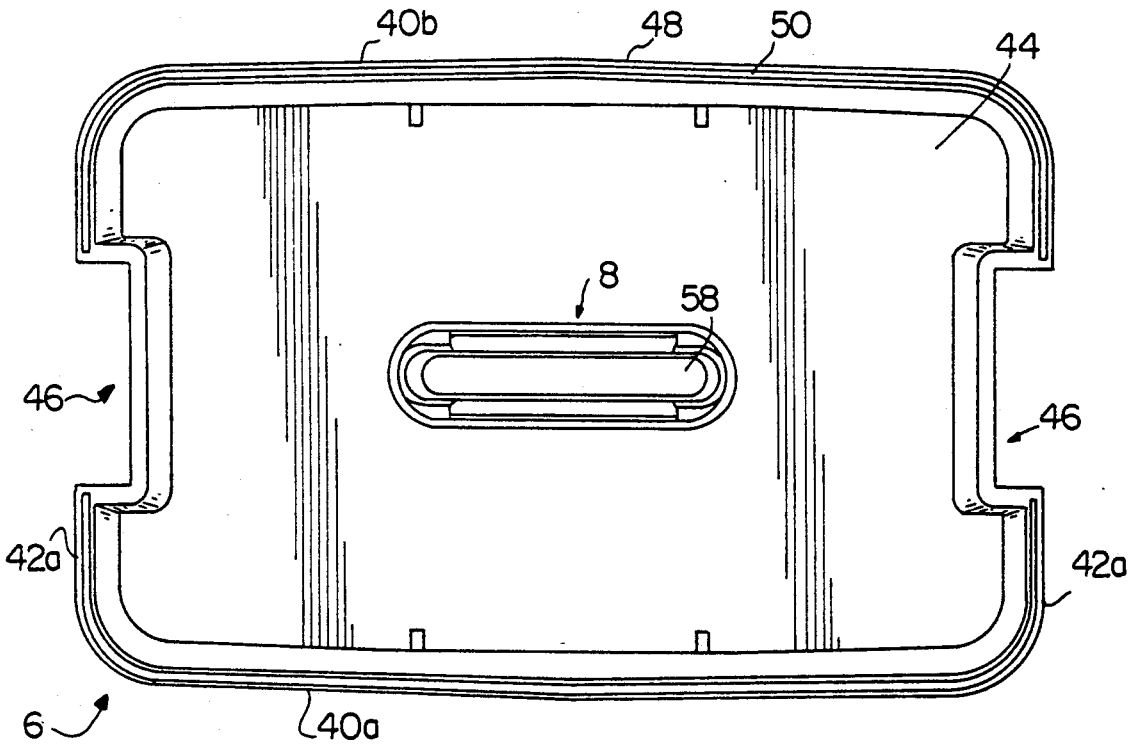
FIG. 5B

FIG. 6A
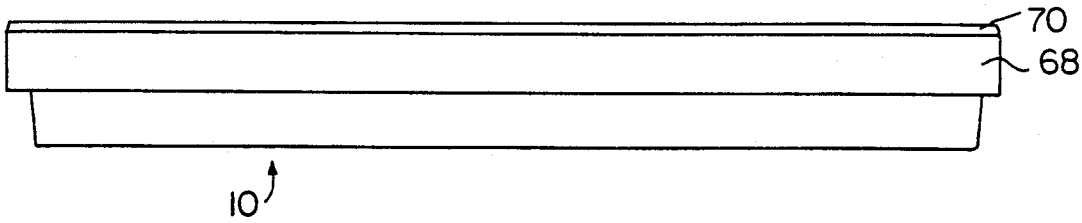
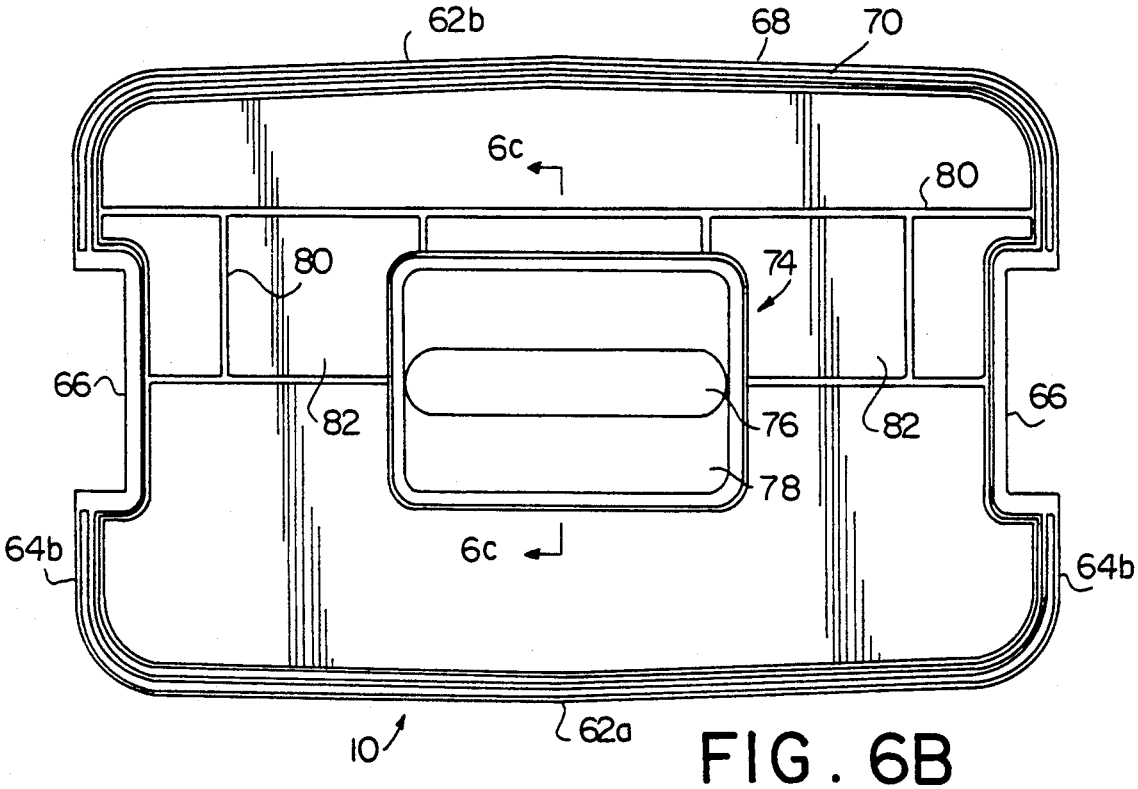
FIG. 6B
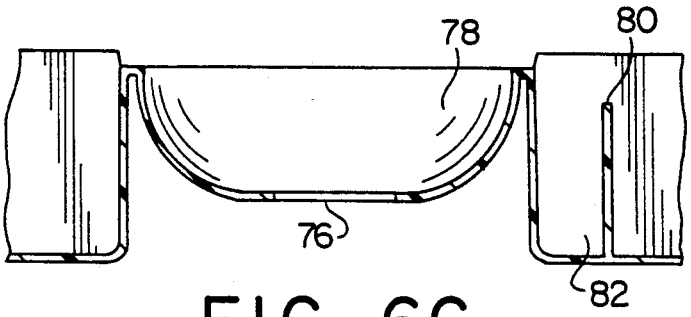
FIG. 6C

FIG. 7A
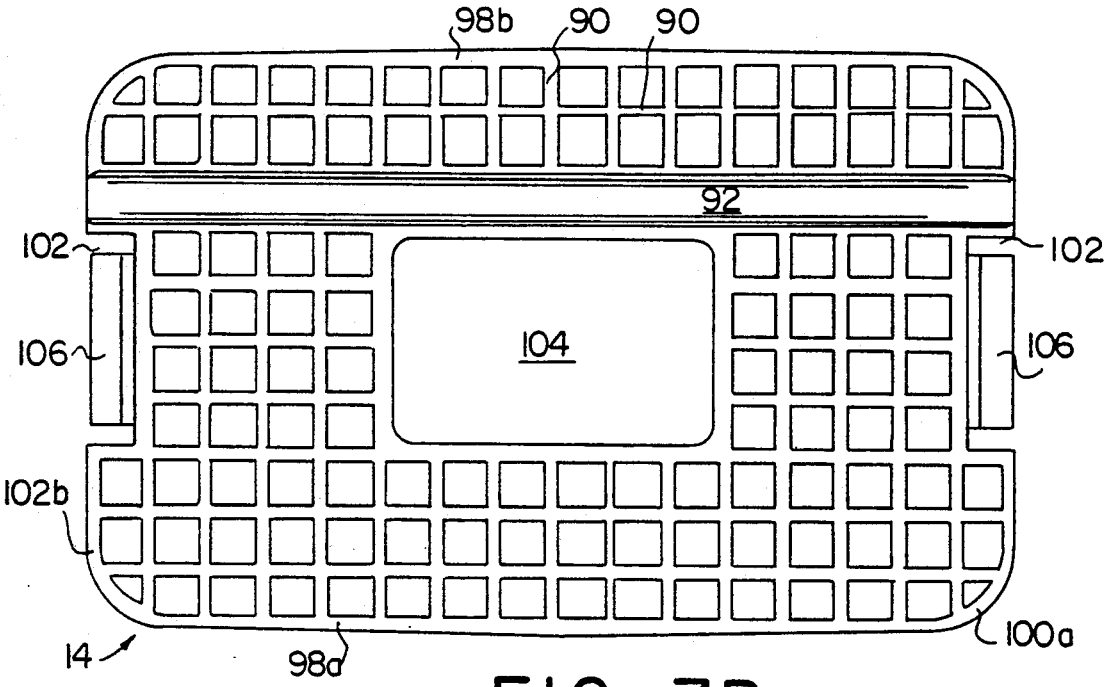
FIG. 7B
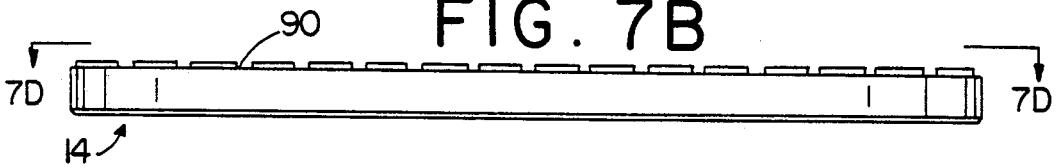
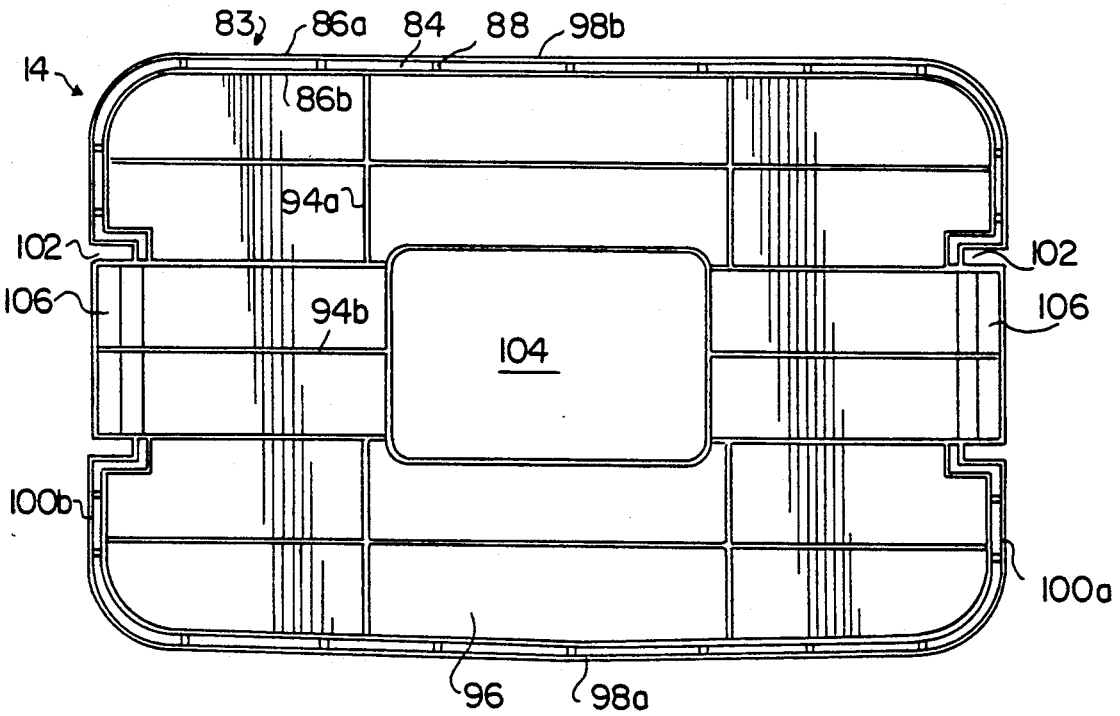
FIG. 7C

PORTABLE STORAGE CONTAINER

FIELD OF THE INVENTION

The present invention is generally directed to a portable storage container for tools and the like, adapted to house a removable, hand-holdable tray assembly, which can be easily transported to a construction site. The storage container may be used as a work surface, a seat or as a step ladder to assist in performing work related tasks.

BACKGROUND OF THE INVENTION

Tool boxes generally contain drawers or trays for storing tools and other construction equipment. In most cases the trays are contained within the tool box and carried as a unit with the tool box.

The trays may be provided with their own handles so that the individual trays can be removed and carried independent of the tool box. When the handles are placed on the sides of the trays for balance, two hands must be used to carry the tray. Other trays have a single handle above the tray which can be carried with one hand. However, such tool boxes typically have arched tops to accommodate the handle of the tray and thus do not provide a flat work surface.

The above mentioned tool boxes are disadvantageous because they do not provide an effective means of removing and carrying individual trays to a construction site without the tool box, or do not provide a suitable work surface. Additionally, standard steel-type tool boxes are heavy and therefore limit the number of tools that can be carried in a single trip. While some tool boxes are now made of lightweight materials such as plastics, none provide the combination of a convenient, removable hand-holdable tray assembly and a flat work surface.

SUMMARY OF THE INVENTION

The present invention is directed to a storage apparatus having therein a tray assembly which may be easily removed and carried with a single hand. The tray assembly, which may include a plurality of nested trays, can be readily lifted out of the tool box. This is accomplished by a centrally positioned handle extending upward through openings in the nested trays making the tray assembly readily accessible to the user while still in the tool box.

In another aspect of the invention, the tool box has a cover which provides a work surface for sawing, drilling and the like. The work surface preferably has a non-skid texture. Means are preferably provided on the work surface for stabilizing round objects, such as wooden dowels, to facilitate such work activities. The cover is mounted on the tool box to form a rigid surface which can also be used as a bench for standing or sitting.

The present invention is more specifically directed to a portable storage apparatus comprising:

- a container;
- a cover means removably mounted on the container and having a work surface; and
- a hand-holdable tray assembly adapted to be inserted into the container in nesting relationship therewith and comprising a first or base tray means having a centrally positoned upwardly extending handle means adapted to be gripped by the user.

The tray assembly preferably comprises at least one second or nesting tray means adapted to fit in nesting relationship with the first tray means having an opening for allowing user access to the upwardly extending handle means extending from the first tray means. Accordingly, the first and second tray means can be removed together from the container by gripping the handle and lifting the tray assembly upward and out of the container.

The cover means also includes an opening allowing access to the handle of the first tray means, to enable the user to readily grip the handle and carry the closed apparatus. The handle does not extend above the work surface on the top of the cover when the apparatus is in its closed configuration. Thus the top of the cover provides a flat surface for carrying out a variety of work related tasks.

In another aspect of the invention, a latching mechanism is provided which effectively secures the components of the apparatus together in a closed configuration. The latching mechanism comprises eccentric cams attached to opposed sides of the container which engage the cover means when the cover means is operatively placed over the container. Means may also be provided for preventing rotation of the cam and thereby prohibiting unauthorized entry into the container. The eccentric cams can be preferably gripped by the user so that the apparatus can be carried from its sides.

Support means, preferably in the form of reinforcing ribs, are provided in the apparatus to increase structural integrity and to provide additional support for the tray assembly. As a result, the apparatus is sufficiently strong to enable the user to work, sit or stand on the apparatus.

The apparatus, including the container, tray means and cover, is preferably made of a high density plastic material such as a polypropylene for reduced weight and increased strength and toughness. High density polypropylene is also desirable because it is impervious to most chemicals including acids and oils. The latch assembly is preferably made of a high impact ABS plastic and the like.

BRIEF DESCRIPTION OF THE DRAWINGS

The following drawings, in which like reference characters indicate like parts, are illustrative of embodiments of the invention and are not intended to limit the scope of the invention as encompassed by the claims attached hereto and forming a part hereof.

FIG. 1 is a perspective view of an embodiment of a fully assembled apparatus of the present invention;

FIG. 2 is an exploded perspective view of the apparatus of the present invention;

FIG. 3A is a front elevational view of an embodiment of the bottom compartment of the present invention;

FIG. 3B is a plan view of the bottom compartment shown in FIG. 3A without the side cams in place;

FIG. 5A is a front elevational view of an embodiment of the base tray of the present invention;

FIG. 5B is a plan view of the base tray shown in FIG. 5A;

FIG. 6A is a side elevational view of an embodiment of the nesting tray of the present invention;

FIG. 6B is a plan view of the nesting tray shown in FIG. 6A;

FIG. 6C is a partial sectional view of the nesting tray shown in FIG. 6A through line 6C—6C of FIG. 6B;

FIG. 7A is a plan view of an embodiment of the cover of the present invention;

FIG. 7B is a side elevational view of the cover shown in FIG. 7A;

FIG. 7C is a partial bottom view of the cover shown in FIG. 7A;

DETAILED DESCRIPTION OF THE INVENTION

Figure 3C:
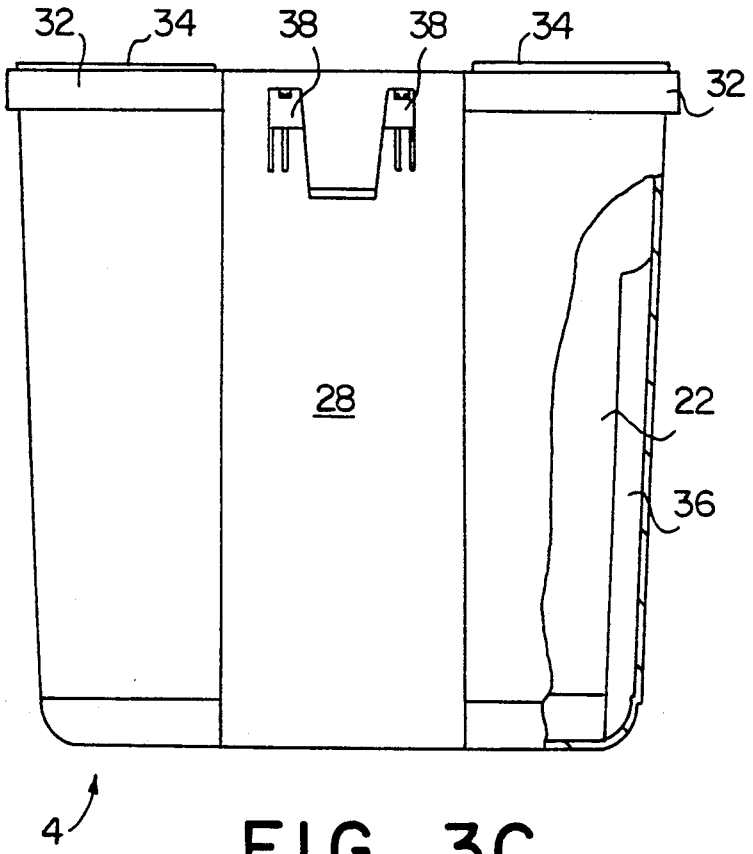
FIG. 3C is a side elevational view of the bottom compartment shown in FIG. 3A without the side cams in place.

As shown in the drawings, there is disclosed a preferred embodiment of a portable container of the invention having a tray assembly which can be easily removed and transported. The container also has a cover adapted to provide a work surface thereon, particularly for drilling, sawing and the like. The cover is sufficiently strong so that it can support the weight of the user while sitting or standing thereon.

Referring specifically to FIGS. 1 and 2, a portable container 2 of the present invention comprises a base or bottom compartment 4, a base tray 6 having an upwardly extending handle 8 and at least one nesting tray 10. The nesting tray 10 is adapted to fit within and be readily removed from the base tray 6. Two or more nesting trays 10 may be used with each stacking one on top of the other. Each nesting tray 10 has an opening 12 for receving the handle 8 of the base tray 6 so that when the handle 8 is lifted both the base tray 6 and the nesting trays 10 are easily removed from the bottom compartment 4.

The container 2 also includes a cover 14 having a work surface 16 and a centrally disposed opening 18 through which the user can grip the handle 8 of the base tray 6 as shown in FIG. 1. The cover 14 is mountable on the bottom compartment 4 and secured thereon by a latch assembly 20 mounted to the opposed sides of the bottom compartment 4.

The bottom compartment 4, shown best in FIGS. 3A–3C, forms the base of the container 2 and supports all of the components of the apparatus stacked therein in nesting relationship. The bottom compartment 4 includes a storage area 22 defined by opposed sides 24*a*, 24*b* and 26*a*, 26*b*. One pair of opposed sides (sides 26*a* and 26*b* shown in FIG. 3B) is provided with longitudinally extending recesses 28 for housing the latch assembly 20 as hereinafter described.

Figure 4:
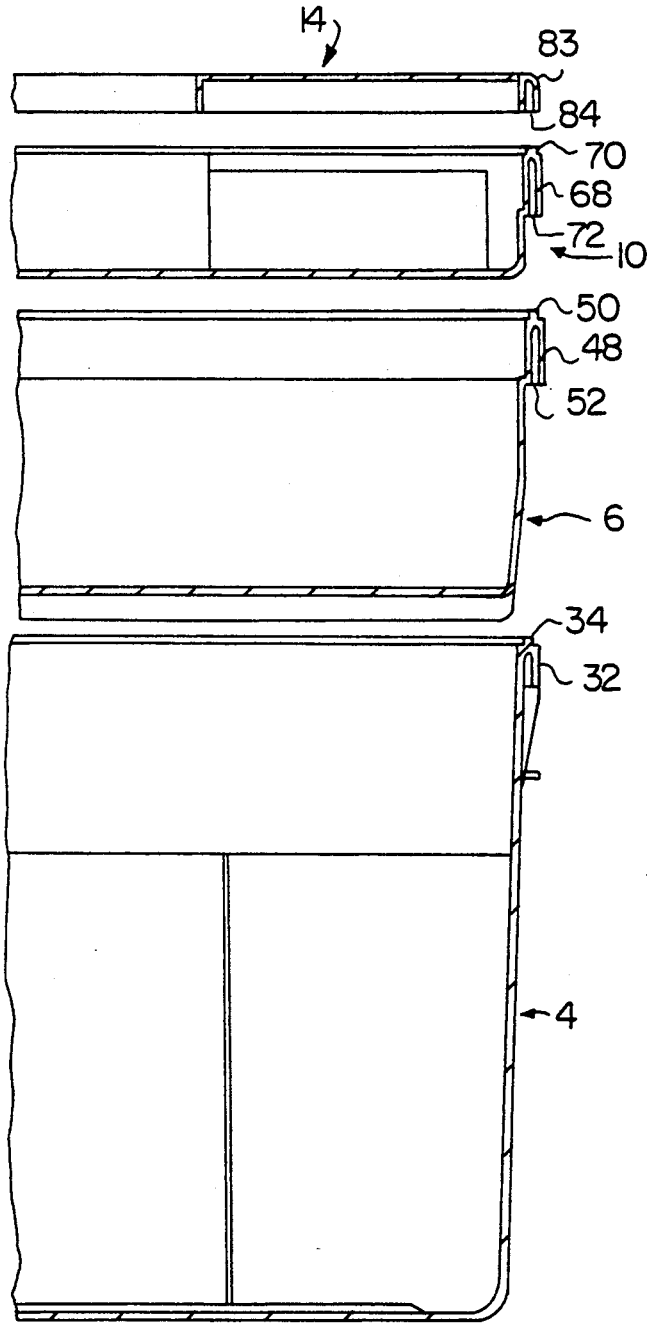
FIG. 4 is a partial exploded elevational view of the components of the assembled apparatus.

Means are provided in the upper portion of the bottom compartment 4 for engaging the stackable components in nesting relationship while stored within the bottom compartment 4 as shown best in FIGS. 3B and 4. Specifically, the engaging means 30 is adapted to engage the base tray 6 and secure the same within the storage area 22 while adding to the overall strength of the bottom compartment 4. The engaging means 30 of the bottom compartment 4 includes a rim 32 having an upwardly extending projection 34 thereon which is adapted to engage a corresponding channel of the base tray 6 as described in detail hereinafter. As a result, the base tray 6 is securely nested within the bottom compartment 4.

The bottom compartment 4 includes ribs 36, best shown in FIGS. 3B and 3C, which engage the base tray 6 when the base tray 6 is nested within the storage area 22. The ribs 36 provide additional support for the base tray 6, and strengthen the sides 24, 26 of the container. The ribs 36 preferably have a shape which facilitates engagement with the base tray 6. Thus, if the bottom of the base tray 6 has rounded corners, the tops of the ribs are preferably concave.

The recesses 28 in the opposed sides 26*a*–26*b* of the bottom compartment 4 are provided with extensions 38 adapted to be engaged by the latch assembly 20 and thereby secure the cover 14 to the bottom compartment 4.

The base tray 6 is adapted to nest within the bottom compartment 4 and support the nesting trays 10 forming part of the tray assembly. Referring to FIGS. 5A and 5B the base tray 6 is formed by opposed pairs of sides 40*a*, 40*b* and 42*a*, 42*b* defining a storage area 44. Opposed sides 42*a*, 42*b* have longitudinally extending recesses 46 corresponding to the recesses 28 in the bottom compartment 4. Thus, the exterior surface of the base tray 6 conforms to the interior surface of the bottom compartment 4 and enables the base tray 6 to nest within the bottom compartment 4.

As shown best in FIG. 4, the base tray 6 includes a rim 48 and an upwardly extending projection 50 which is adapted to engage and support a nesting tray 10 placed within the base tray 6. The rim 48 has a channel 52, preferably about ⅝ inch wide, which is adapted to engage the projection 34 on the rim 32 of the bottom compartment 4 to align and secure the base tray 6 and the bottom compartment 4 in nesting relationship.

The base tray 6 is removable from the bottom 4 by lifting the handle 8. As shown best in FIGS. 2 and 5A, the handle 8 includes a base 54, a pair of opposed columns 56, a connecting bar 58, together defining an opening 60. The handle is engaged by placing the hand within the opening 60 and gripping the connecting bar 58. The connecting bar 58 is therefore preferably sized to facilitate gripping by the human hand.

The base tray 6 is adapted to support at least one nesting tray 10 therein. As shown in FIGS. 6A–6C, the nesting tray 10 includes opposed pairs of sides 62*a*, 62*b* and 64*a*, 64*b*. The sides 64*a*, 64*b* have longitudinally extending recesses 66 which conform the exterior surface of the nesting tray 10 to the interior surface of the base tray 6. This arrangement enables the nesting tray 10 to nest securely within the base tray 6.

The nesting tray 10 includes means for engaging a cover (or another nesting tray) placed upon it in nesting relationship. Means are also provided for engaging the base tray 6 so that the components of the tray assembly are secured to each other and to the bottom compartment 4. As shown in FIG. 4, the nesting tray 10 includes a rim 68, an upwardly extending projection 70 and a channel 72, preferably about ⅜ inch wide, which are similar in structure and function to the corresponding components described previously for the base tray 6. Specifically, the channel 72 is adapted to engage the projection 50 of the base tray 6. The projection 70 of the nesting tray 10 is adapted to engage a corresponding channel in the rim of the cover 14. In this way, each of the nested components; the bottom compartment 4, the base tray 6 and the nesting tray 10 are secured to each other when the components are assembled in the container 2.

Referring again to FIGS. 6B and 6C, the nesting tray 10 has a centrally positioned region 74 adapted to permit the handle 8 of the base tray 6 to extend upward through the nesting tray 10 and to protect against accidental discharge of the contents of the base tray 6 and bottom compartment 4. Specifically, the nesting tray 10 has an opening 76 for receiving the handle 8 and a barrier in the form of a depression 78 which surrounds the opening 76 and thereby prevents loose tools and construction equipment from escaping the base tray 6 while allowing user access to the handle 8.

The nesting tray 10 is preferably adapted to store small hardware items such as screws, nuts, bolts, nails, washers and the like. Access to such small hardware items is facilitated by the use of dividers 80 which may be arranged to form compartments 82. The size of the compartments 82 may vary to accomodate particular hardware items. As shown in FIGS. 2 and 6B both small and large compartments 82 may be provided within the nesting tray 10 according to need.

Although only one nesting tray 10 is illustrated and described, it should be readily understood by those skilled in the art that additional nesting trays may be added to the tray assembly. Each additional nesting tray will have an engaging means including a rim, an upwardly extending projection and projection-receiving channel so that the nesting tray can be secured to the tray below it and to either the cover 14 or tray above it. The sides of the nesting trays will have longitudinally extending recesses to conform their shape to that of the other components of the container. In addition, a central opening should be provided to permit access to the handle 8 extending upwardly from the base tray 6.

The cover 14 of the container 12 is adapted to engage the uppermost nesting tray 10 and to be secured to the container 2 by the latch assembly 20. The top of the cover when secured to the container 2 provides a work surface 16 for sawing, drilling and the like and is sufficiently strong to support the weight of the user while standing or sitting thereon.

Referring to FIGS. 7A–7D, the cover 14 includes a rim 83 having a channel 84 therein for receiving the projection 70 of the nesting tray 10 as shown also in FIG. 4. The channel 84, preferably about ⅜ inch wide, is formed between respective walls 86*a*, 86*b* of the rim 83 having cross-ribs 88 for added support for the cover 14 and to provide a secure attachment between the cover 14 and the upper nesting tray 10.

The top or work surface 16 of the cover 14 preferably has a non-skid surface provided by cross-hatching of grooves 90 over at least a portion of the surface. Alternatively, a coarse or textured surface may be applied to the top of the cover 14 by gluing and the like. Still further, a padded surface may be applied to the cover particularly if the container 2 will be often used for sitting or standing. Working on round or curved objects such as wooden dowels, steel bars and the like can be facilitated by providing a arcuate groove 92 along the length of the cover 14. Such round objects can be held in the groove 92 for easier sawing, drilling and the like.

The cover 14 is preferably provided with support ribs 94 on its under surface 96. The support ribs 94 preferably extend between at least one pair of opposed sides. As shown best in FIG. 7C the support ribs 94*a* extend between opposed sides 98*a*, 98*b* and the support ribs 94*b* extend between opposed sides 100*a*, 100*b*. The ribs 94 are adapted to transfer a load applied to the cover 14 to the respective rims 68, 48 and 32 of the nested components.

Opposed sides 100*a* and 100*b* are provided with longitudinally extending recesses 102 to thereby conform the shape of the cover 14 to the components 6, 10 of the tray assembly and the bottom compartment 4 and to permit the latch assembly 20 to engage the cover 14. The cover 14 is also provided with a centrally positioned opening 104 for receiving the handle 8 from the base tray 6. The opening 104 is sufficiently wide to enable the user to grip the handle 8 and lift the container 2 including the tray assembly. The cover 14 also includes an extension 106 on opposed sides 100*a*, 100*b* for engaging the latch assembly 20 as described hereinafter.

As shown best in FIGS. 2, 3B, 5B, 6B, 7A and 7C each of the component parts of the portable container 2 may be molded to include bowed out sides to more effectively distribute weight and for greater support, particularly to support the user while sitting, standing or working on the container 2. For example, as shown in FIGS. 2 and 3 the sides 24*a* and 24*b* of the bottom compartment 4 are provided with bowed out sides which can be incorporated into the container 2 by techniques well known in the art.

The latch assembly 20, as shown in FIGS. 8A–8D, includes an eccentric cam 108 having a top section 110 and a bottom section 112. The top section 110 has a base 114 with a centrally disposed opening 116 having a key slot 118 therein. The opening 116 is preferably dimensioned so as to permit the user to insert a hand to thereby hold the container 2 from the sides or to insert a strap assembly as described hereinafter. Extending downward from the opening 116 are a pair of opposed legs 120 with transverse holes 122 therein for receiving locking screws or pins 124.

The bottom section 112 of the cam 108 comprises a base 126 having a centrally disposed slot 128 surrounded by a depression 130 extending from the base 126 toward the slot 128. The upper portion of the bottom section 112 includes a pair of opposed slots 132 formed between upwardly extending arms 134 and a centrally disposed column 136. The arms 134 and 136 are provided with transverse holes 138 for receiving a rod 140 therein. Positioned at the bottom of on the arms 134 are holes 142 for receiving the locking screws or pins 124 which pass through the transverse holes 122 in the legs 120 of the top section 112. As a consequence, the top section 110 is secured to the bottom section 112 of the latch assembly.

Figure 8A:
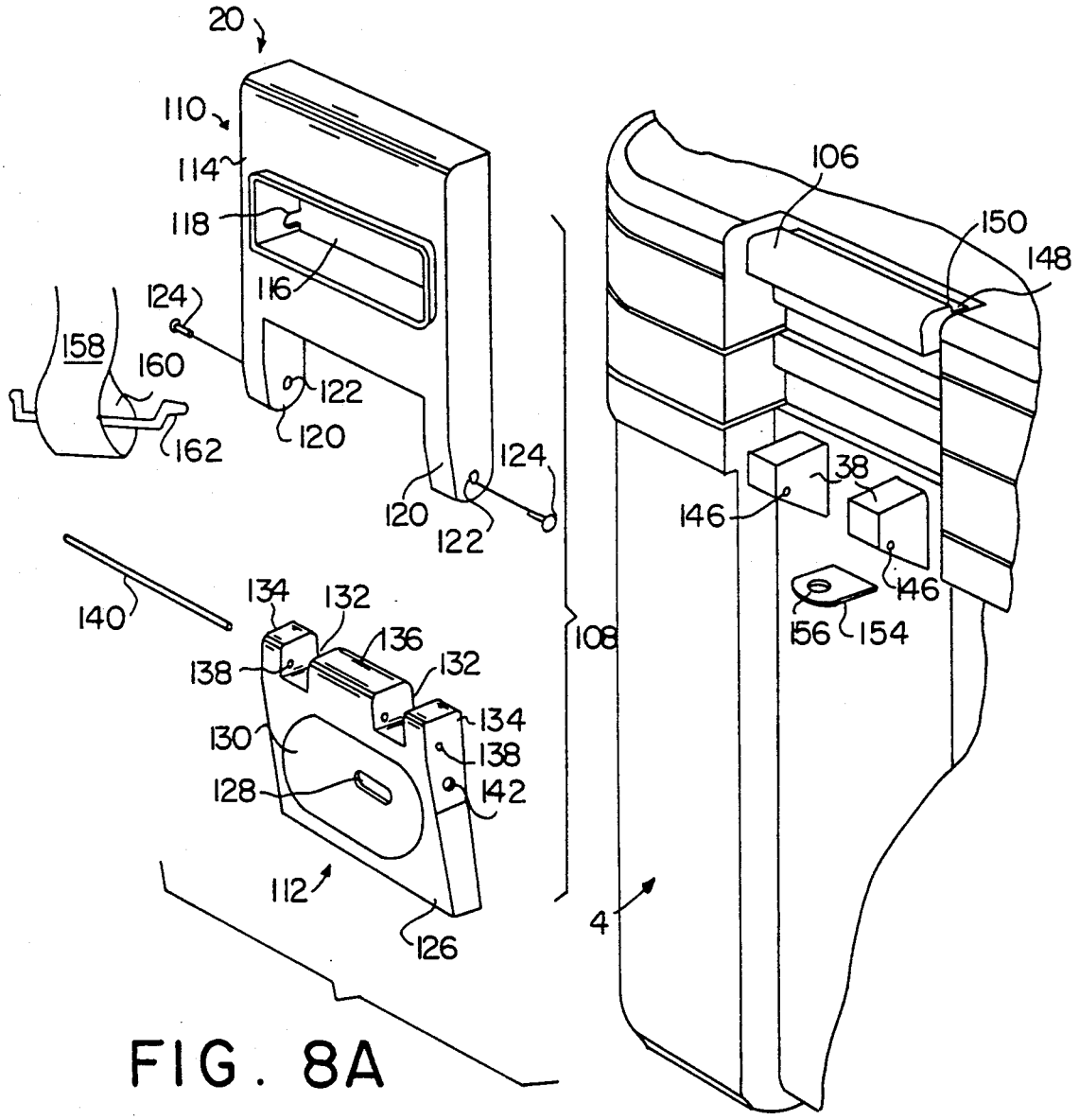
FIG. 8A is a perspective view of an embodiment of the latch assembly of the present invention.
Figure 7D:
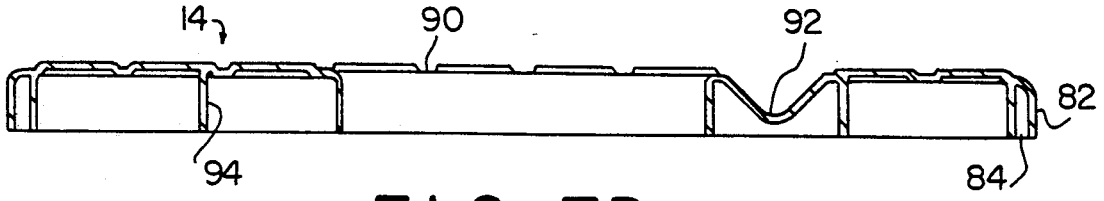
FIG. 7D is a cross-sectional view of the cover shown in FIG. 7A taken along line 7D—7D of FIG. 7B.

The cam 108 is pivotally attached to the bottom compartment 4 so that the cam 108 can be moved from a locked position wherein the top section 110 engages the cover 14 to an unlocked position. As shown in FIG. 8A, the bottom compartment 4 is provided with a pair of opposed extensions 38 within the recesses 28 and spaced apart sufficiently so that they are insertable into the slots 132 of the bottom section 112 of the cam 108. The extensions 38 have transverse holes 146 which are adapted to receive the rod 140. When extensions 38 are aligned in the slots 132 and the rod 140 extends through the transverse holes 138 and 146, the bottom section 112 of the cam 108 is pivotally mounted to the bottom compartment 4.

The top section 110 of the cam 108 is adapted to engage the cover 14 when the latch assembly 20 is in the locked position. The cover 14 is therefore provided with an extension 106 including a ledge 148 and a lip 150. As shown in FIGS. 8B and 8C the top section 110 is provided with a downwardly extending projection 152 adapted to engage the lip 150 as shown in FIG. 8A to thereby lock the cover 14 on the container 2.

Figure 8D:
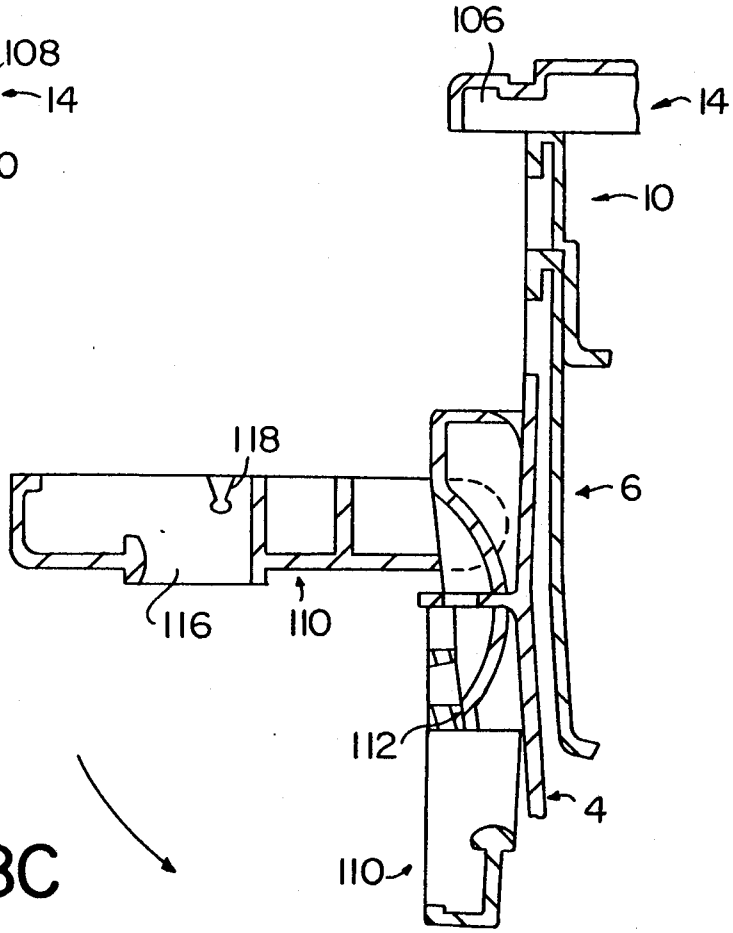
FIG. 8D is a partial cross-sectional view of the latch assembly of FIG. 8A in the fully opened position.
Figure 8C:
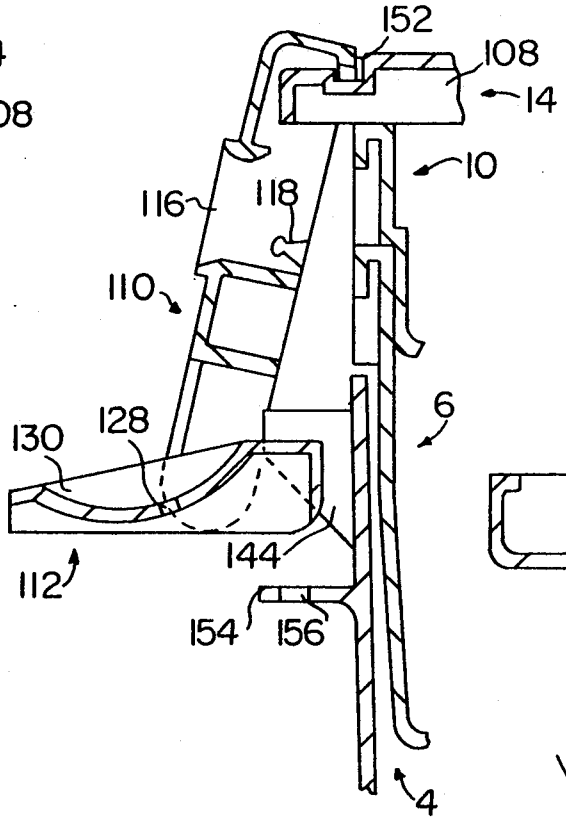
FIG. 8C is a partial cross-sectional view of the latch assembly of FIG. 8A in a partially unlocked position.
Figure 8B:
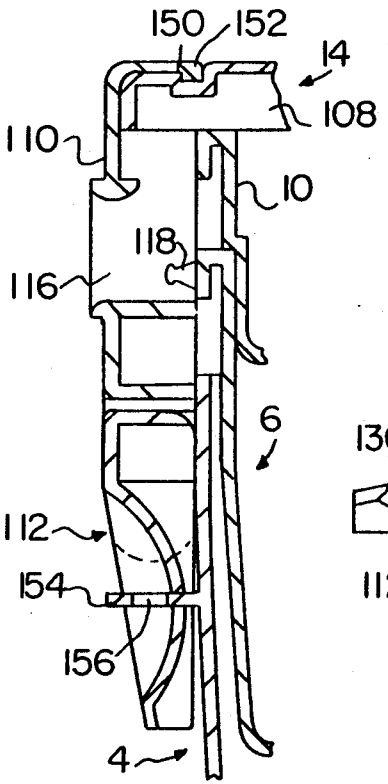
FIG. 8B is a partial cross-sectional view of the embodiment of the latch assembly shown in FIG. 8A in the locked position.

The locking and unlocking of the latch assembly 20 is shown in the sequence of FIGS. 8B–8D. In FIG. 8B, the projection 152 of the top section 110 of the cam 108 is secured in locking engagement against the lip 150 of the extension 106. The bottom section 112 of the cam 108 lies flat against the bottom compartment 4 within the recess 28. The unlocking of the cam 108 commences as shown in FIG. 8C. The bottom section 112 is lifted by the user which causes the top section 110 to pivot about the lock pin 124 and thereby disengage the projection 152 from locking engagement with the lip 150. Thereafter, as shown in FIG. 8D, the top section 110 rotates rearwardly away from the cover 14 in the direction of the arrow until it rests within the recess 28 of the bottom compartment 4.

The container 2 may be protected against unauthorized entry through the use of a padlock or other locking mechanism which prevents the bottom section 112 of the cam 108 from being lifted. Preferably, the recess 28 of the bottom compartment 4 is provided with an outwardly extending tab 154 as shown in FIG. 8A adapted to extend through the opening 128 in the bottom section 112 of the cam 108. The tab 154 is provided with a hole 156 of sufficient diameter to enable a padlock or other suitable device to extend therethrough and prevent the cam 108 from being lifted.

As previously indicated, the assembled container including the bottom compartment 4, base tray 6, nested tray 10 and cover 14 may be carried by the handle 8. In addition, the container may be carried over the shoulder by a strap 158 mounted in the opening 116 of the cam 108. As shown in FIG. 8A, the strap 158 is provided with a loop 160 at opposed ends thereof. Extending through the loop 160 is a pin 162 having an L-shaped projection 162 at each end which is adapted to releasably engage the key slot 118 within the opening 116.

Figure 9A:
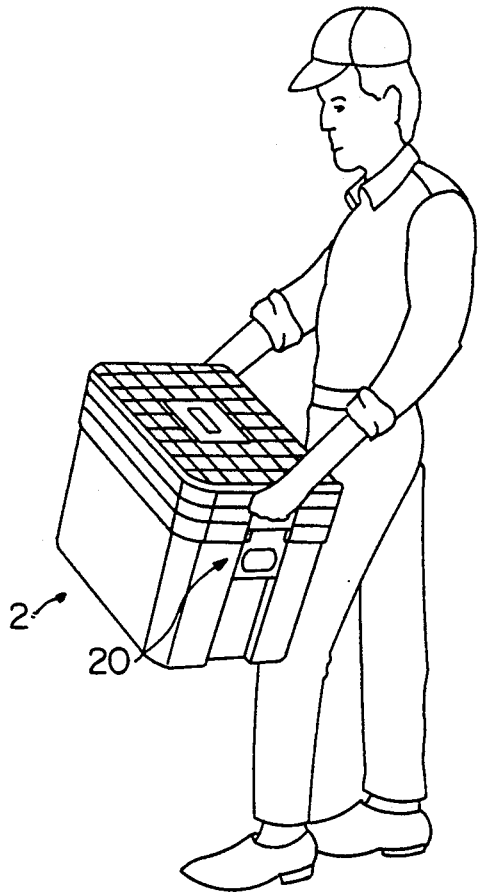
FIG. 9A is a perspective view of the present invention being carried by side handles.
Figure 9B:
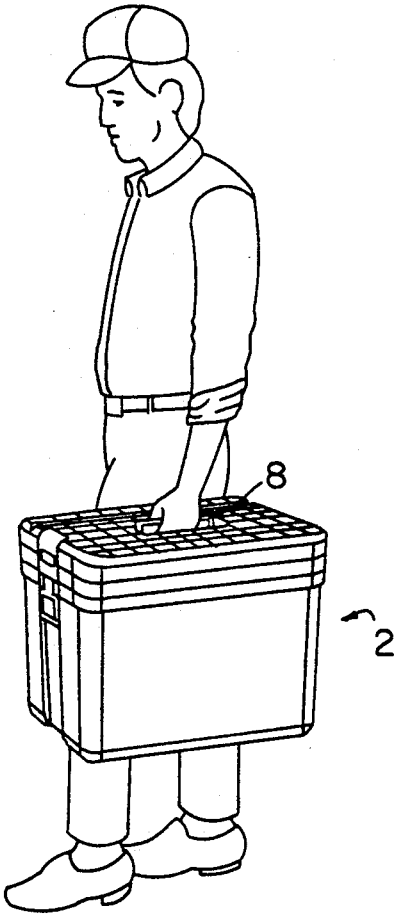
FIG. 9B is a perspective view of the present invention being carried by the centrally positioned handle.
Figure 9C:
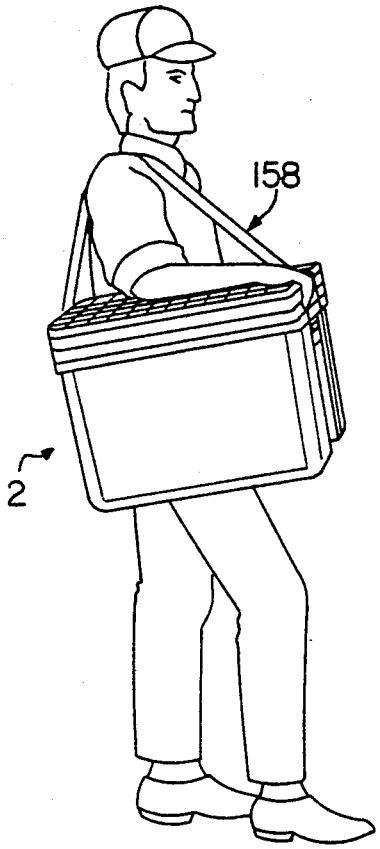
FIG. 9C is a perspective view of the present invention being carried by a strap.

The container 2 of the present invention may be carried in a variety of ways. For example, as shown in FIG. 9A, the user inserts his fingers in the opening 116 of the cam 108 and lifts the container 2 from its sides. In FIG. 9B, the container 2 is shown carried with one hand by gripping the handle 8 extending upwardly from the base tray 6. As shown in FIG. 9C, the container 2 may be carried over the shoulder by the use of the strap 158 fastened to the cam 108.

Figure 9E:
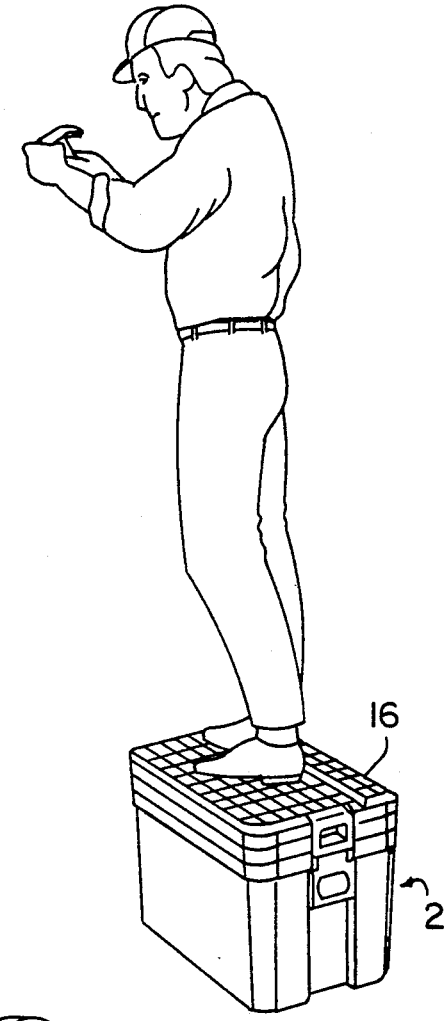
FIG. 9E is a perspective view of a person standing on the container of the present invention.
Figure 9D:
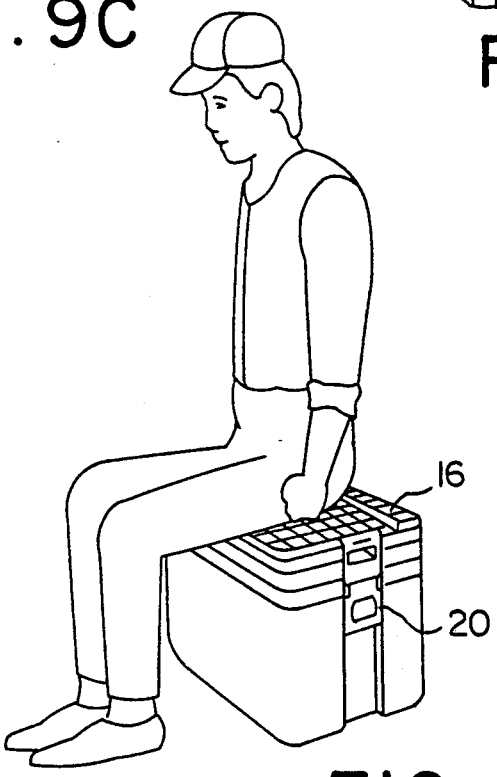
FIG. 9D is a perspective view of a person sitting on the container of the present invention.

The sturdiness of the present invention makes it possible to sit or stand on the container as shown in FIGS. 9D and 9E. Obvious variations of the above-described embodiments of the invention will be apparent to those skilled in the art and are intended to fall within the spirit and scope of the invention.

What we claim is:

1. A portable storage apparatus comprising:

(a) a container;

(b) a cover removably mountable on the container and comprising a work surface thereon, a centrally disposed opening and a recess about the opening of sufficient size to enable entry of a hand; and (c) a hand-holdable tray assembly removably insertable into the container in a nesting relationship thereiwth and comprising a first tray having a centrally positioned handle extending upwardly into the recess of the cover but not above the work surface, said handle adapted to be gripped by the user by placing the hand within the recess.

2. The portable storage apparatus of claim 1 wherein the tray assembly further comprises at least one second tray in nesting relationship with the first tray and comprising an opening for receiving the upwardly extending handle of the first tray, said first and second trays adapted to be removed from the container by lifting the handle.

3. The portable storage apparatus of claim 1 further comprising support means in operative engagement with the cover to enable the cover means to support the weight of the user when the cover is mounted on the container.

4. The portable storage apparatus of claim 2 wherein the container comprises at least one continuous side having an upper end, a bottom and an opening formed by the upper end of the continuous side and thereby defining a storage area and a rim around at least a portion of the opening, siad cover adapted to engage the container at said rim to close said opening.

5. The protable storage apparatus of claim 1 further comprising a latch mounted on to the container and adapted to reversibly engage the cover and thereby secure the cover to the cotnainer and tray assembly within the container.

6. The portable storage apparatus of claim 5 wherein the latch comprises at least one eccentric cam.

7. The portable storage apparatus of claim 6 wherein the latch means comprises two cams on opposite sides of the container.

8. The portable storage apparatus of claim 7 wherein the latch further comprises a handle operatively associated with the eccentric cams to allow the user to lift the apparatus from its sides.

9. The portable storage apparatus of claim 6 further comprising a strap and means for attaching the strap to said eccentric cams to allow the user to lift and carry the apparatus.

10. The portable apparatus container of claim 5 further comprising means to prohibit the latch from disengaging the cover from the container.

11. The portable storage apparatus of claim 1 further comprising means for aligning and securing the cover and tray assembly in nesting relationship.

12. The portable storage apparatus of claim 11 wherein the aligning and securing means comprises a projection and a channel, the projection adapted to be inserted into the channel of one of the components of the apparatus and the channel adapted to receive the projection of another of said components.

13. The portable storage apparatus of claim 12 wherein the container comprises a rim having an upwardly extending projection thereon, the first tray comprises a rim having an upwardly extending projection and a channel therein, wherein when the channel of the first tray receives the projection on the container the first tray is nested in the container.

14. The portable storage apparatus of claim 13 further comprising a second tray having a rim including an upwardly extending projection and a channel, wherein the projection on the first tray is adapted to enter the channel of the second tray and whereby the first tray engages the second tray means in nesting relationship.

15. The portable storage apparatus of claim 10 wherein the latch comprises an eccentric cam and the means to prohibit release of the comprises a tab having a hole therein and which passes through a slot in the bottom section of the cam, thereby exposing said hole in said tab when the cam is in its engaged position, wherein a padlock or the like can be placed through said hole in said tab to prevent release of said cam.

16. The portable storage apparatus of claim 3 wherein the support means comprises structural ribs adapted to direct a downward force to the sides of the container.

17. The portable storage apparatus of claim 2 wherein the second tray further comprises at least one divider to provide compartments in said second tray.

18. The portable storage apparatus of claim 1 wherein the work surface of the cover comprises a non-skid surface.

19. The portable storage apparatus of claim 18 wherein the work surface of the cover further comprises a groove along the length of the cover to support a round object placed thereon.

20. A portable storage apparatus for tools and the like comprising:

a contaner having at least one continuous side, a bottom and an opening defining a storage area, a rim which extends outward around at least a portion of the opening having an upwardly extending projection thereon;

a first tray adapted to nest within the container and having a rim which extends outwardly around at least a portion of said first tray, said rim having an upwardly extending projection thereon and a channel in the bottom of the rim adapted to engage the upwardly extending projection on the rim of the container, and a handle which extends upwardly from the middle of said first tray, said handle means not exceeding the height of a cover;

a cover having a channel around at least a portion of the underside of the perimeter thereof adapted to engage the upwardly extending projection on the rim of the first tray means, an opening in the middle of said cover to allow access to the handle of the first tray and a work surface comprising a non-skid surface; and a latch, comprising opposed eccentric cams attached to the container and adapted to engage the cover, wherein when the cams are rotated to a closed position the cams engage the cover means and thereby secure the apparatus in a closed configuration.

21. The portable storage apparatus of claim 20 further comprising at least one second tray, adapted to fit in nesting relationship to the first tray, having a rim having an upwardly extending projection adapted to engage the channel on the underside of the cover and a channel around at least a portion of the bottom of the rim adapted to engage the upwardly extending projection on the first rim tray, and said secured tray having a centrally located opening to allow access of the handle of the first tray.

22. The portable storage apparatus of claim 20 further comprising handles operatively associated with the eccentric cams on opposed sides of the base of the container.

23. The portable storage apparatus of claim 20 wherein the container, the first tray, and the cover are made from a high density polypropylene.

24. the portable storage apparatus of claim 20 wherein the latch is made from high impact ABS plastic.

* * * * *